United States Patent [19]

Delgado, Jr.

[11] Patent Number: 5,060,436

[45] Date of Patent: Oct. 29, 1991

[54] APPARATUS FOR POSITIONING ANCHOR BOLTS WITHIN CONCRETE

[76] Inventor: David G. Delgado, Jr., 1122 Landsburn Cir., Westlake Village, Calif. 91361

[21] Appl. No.: 543,027

[22] Filed: Jun. 25, 1990

[51] Int. Cl.[5] ..... E04B 1/00

[52] U.S. Cl. ..... 52/295; 52/699

[58] Field of Search ..... 248/231.9, 231.91; 249/93, 98, 48, 95, 231.9; 52/292, 295–298, 699–704, 127.1, 127.2, 364

[56] References Cited

U.S. PATENT DOCUMENTS 2,797,446 7/1987 Miller ..... 52/293
4,614,070 9/1986 Idland ..... 52/296
4,736,554 4/1988 Tyler ..... 249/93

*Primary Examiner*—James L. Ridgill, Jr.
*Attorney, Agent, or Firm*—Jack C. Munro

[57] ABSTRACT

An anchor bolt positioning apparatus which is to be used to mount an anchor bolt which is to be embedded within concrete. The apparatus utilizes an elongated planar plate upon which is centrally mounted a hollow sleeve. The threaded end of the anchor bolt is to be positioned within the hollow sleeve and extend outwardly therefrom with a nut to be threadably engaged with the threaded end of the anchor bolt and this nut then resting on the outer free edge of the sleeve. The inner end of the anchor bolt is to extend in the area defined by a pre-erected form for the concrete.

3 Claims, 1 Drawing Sheet

APPARATUS FOR POSITIONING ANCHOR BOLTS WITHIN CONCRETE

BACKGROUND OF THE INVENTION

The field of this invention relates to construction and more particularly to a positioner to support an anchor bolt at a precise position prior to pouring of concrete such as used within slabs and footings.

Concrete is commonly used within footings and slabs for buildings, houses, patio covers and other similar types of structures. It is common to locate anchor bolts within the concrete with these anchor bolts to then be used to attach the walls or supporting beams of the building, house or patio cover to the concrete. An anchor bolt is normally constructed of metal and has an inner threaded end an an outer end which is bent forming a hook-shaped configuration. This hook-shaped configuration is designed to be embedded within the cement with the threaded end of the hook to extend above the level of the cement. It is to this threaded end that the wall or beam of the building, house, or patio cover is to be attached.

Code requirements specifically define the length of the anchor bolts, their diameter, how much of the anchor bolt is to extend above the upper surface of the cement, the exact distance the anchor bolts are to be apart, and exactly what is to be the spacing of the anchor bolt from the outer peripheral edge of the cement. It is typical within the industry to utilize a short wooden strip that is to be nailed to the pre-erected form for the cement within which is to be poured the concrete. The anchor bolt is attached to the wooden strip by wire or other similar type of archaic fastening arrangement. Within a typical footing or slab, there will normally be utilized a plurality of such anchor bolts. The so locating of such anchor bolts commonly results in these wooden strips assuming a slightly misaligned position. This misalignment will result in the anchor bolt, after the pouring of the cement, assuming a corresponding misaligned position. This misalignment may be minor such as being only a quarter of an inch off. However, such a minor amount of misalignment can create serious problems when trying to mount the walls or beam in their proper position. Also, misalignment is not only due to incorrect spacing between the anchor bolts but also can be due to the anchor bolt assuming a canted position.

At the present time, the building codes are becoming more strict and requiring that the anchor bolts be mounted by some form of a positioning apparatus to insure that the anchor bolts are located in their proper position according to the architectural requirements after the pouring of the cement.

SUMMARY OF THE INVENTION

The structure of the present invention includes a mounting plate which is to be placed between parallel wooden boards of a pre-erected form for concrete. Placed on the upper edge of the boards are a pair of aligned marks which have been inscribed with a pencil or other similar type of writing instrument. This mounting plate includes a pair of visual observing openings with a said such opening being located directly adjacent each end of the mounting plate. A mark on a board is to be centrally oriented within its respective visual observing opening. Associated directly adjacent each visual observing opening is a series of holes with a nail to engage with at least one hole of each series. The nail is to be embedded within the board resulting in the mounting plate being correctly positioned therebetween. Mounted on the upper surface of the mounting plate is an upstanding sleeve with there being a through opening formed within the sleeve. The sleeve is of a preselected length according to the requirements for the particular length of anchor bolt. The anchor bolt is to be located within the sleeve with the threaded end of the anchor bolt protruding exteriorly of the upper surface of the sleeve. A conventional nut is to be engaged with the threaded end of the anchor bolt and caused to rest against the outer free end of the sleeve so that the desired length of the anchor bolt be positioned above the upper surface of the cement that is to be poured between the boards and ultimately secured.

DETAILED DESCRIPTION OF THE SHOWN EMBODIMENT

Figure 1:
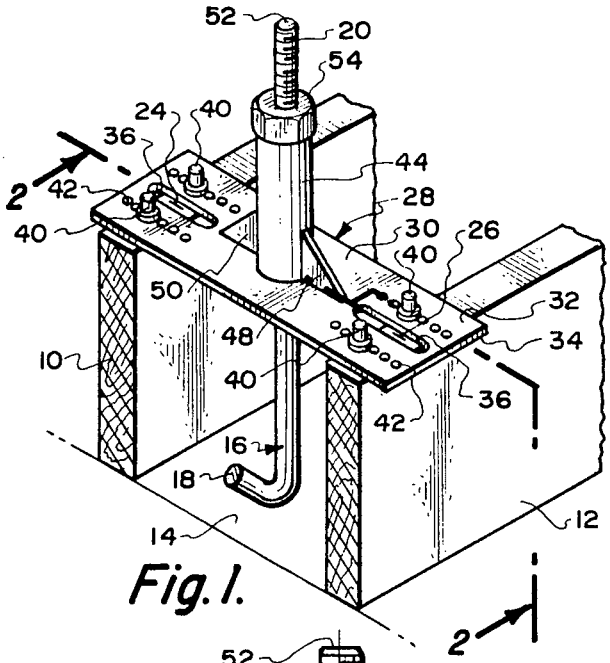
FIG. 1 is an isometric view of the anchor bolt positioning apparatus of this invention showing an anchor bolt being located in the proper position between a pair of parallel, spaced apart, board members of a pre-erected form for cement.

Referring particularly to the drawing, there is depicted boards 10 and 12 which are laid in a parallel position with the longest dimensions of the boards 10 and 12 being located vertical. The boards 10 and 12 will generally be identical in configuration. Between the boards 10 and 12 is located a space 14. It is within this space 14 cement (not shown) that is to be poured and will form the footing for a building or patio structure (not shown). It is to be understood that once this cement is to be poured that the boards 10 and 12 will be removed.

Within the cement, there is to be embedded a plurality of anchor bolts 16. Each anchor bolt 16 is basically cylindrical and generally to be between one quarter of an inch in a diameter to over an inch in diameter. Also, the length of the anchor bolt 16 will generally vary. The diameter and the length of the anchor bolt 16 will be selected according to the requirements of the particular installation.

Normally, the anchor bolt 16 will be constructed of metal such as steel. Anchor bolt 16 has an outer end formed into a hook 18 with the inner end of the anchor bolt 16 including a series of screw threads 20. The main body of the anchor bolt 16 has a longitudinal center axis 22. During embedding of the anchor bolt 16 within the cement that is to be poured within the space 14, the axis 22 should be located at the middle of the width of the space 14. Selecting of the longitudinal position of the anchor bolt 16 relative to the space 14 is according to the architectural requirements. Such longitudinal locations are normally noted by the inscribing of a lined pair of marks 24 and 26 on the top edge of boards 10 and 12, respectively.

Prior to pouring of the cement within the space 14 there is utilized the apparatus 28 of the present invention for locating the anchor bolt 16 in its required position as the cement is poured. The apparatus 28 includes a planar, substantially rectangularly shaped mounting plate 30. Mounting plate 30 has an upper surface 32 and a bottom surface 34. Mounting plate 30 has a pair of opposite ends, each of which includes identically sized visually observation openings 36. It is to be noticed that the openings 36 are identically shaped and are elongated. When positioning the mounting plate 30 on the top edge of the boards 10 and 12, the mark 24 is to be centered transversely within one of the openings 36 with the mark 26 centered transversely within the other of the openings 36.

Figure 2:
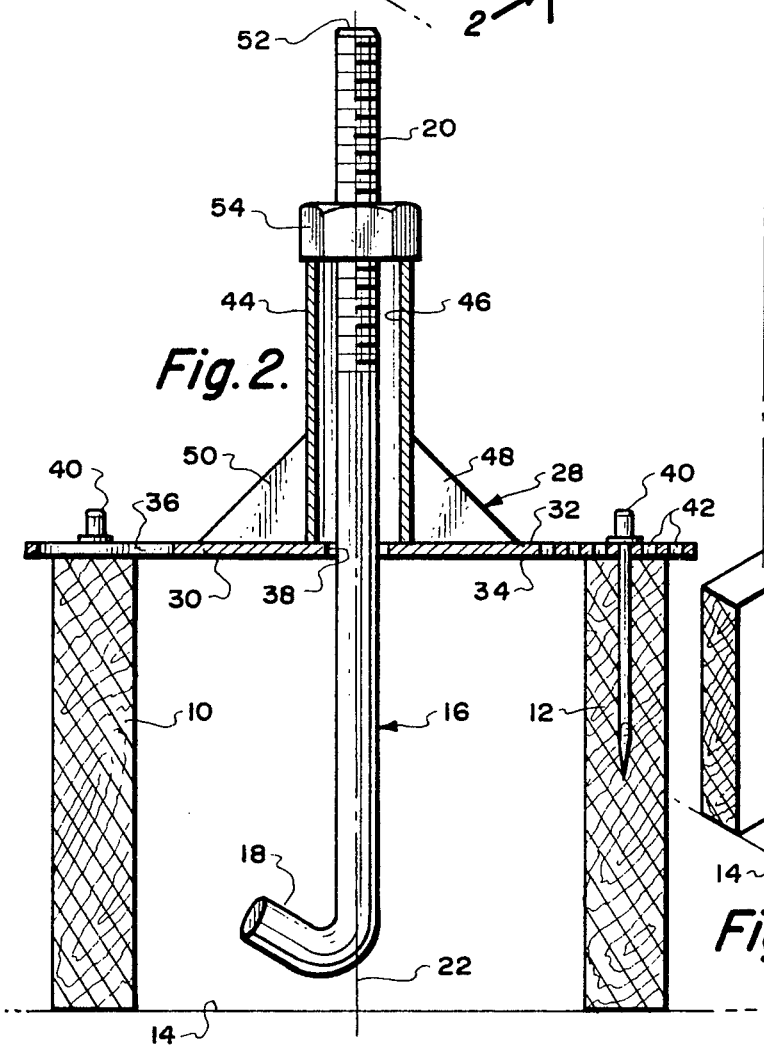
FIG. 2 is a cross-sectional view taken along line 2—2 of FIG. 1.
Figure 3:
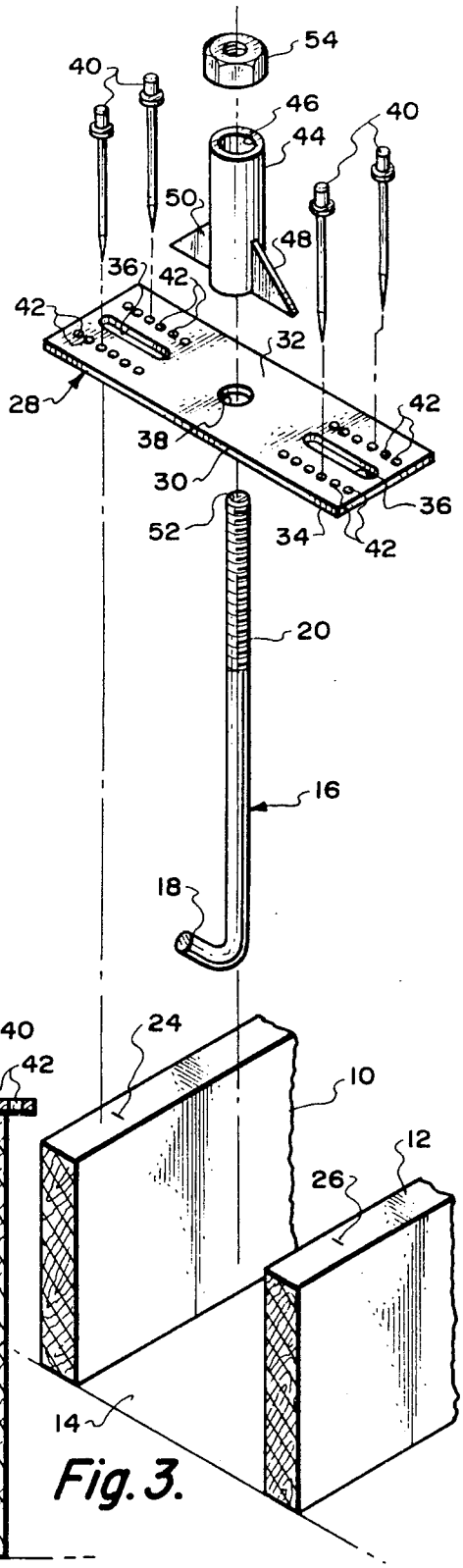
FIG. 3 is an exploded isometric view of the structure shown in FIG. 1.

Also, formed within the mounting plate 30 is a hole 38. This hole 38 is located substantially at the longitudinal mid-point of the plate 30. The hole 38 is to be located at the transverse mid-point of the space 14 as is clearly shown in FIGS. 1 and 2 of the drawing. At this particular time, nails 40 are to be embedded within the boards 10 and 12. The nails 40 are to be conducted through holes 42 formed within the plate 30. It is to be noted that there are actually four different series of holes 42 with one series being located on one side of a hole 36 and another series of holes 42 being located on the opposite side of a hole 36. The same is true for the opposite hole 36. The net result is that there are two series of holes 42 located at one end of the mounting plate 30 with another two series of the holes 42 being located at the opposite end of the mounting plate 30.

Mounted on the upper surface 32 of the mounting plate 30 is an upstanding sleeve 44. This sleeve 44 is open at each end and has a hollow interior chamber 46. Sleeve 44 is fixedly mounted on the upper surface 32 and supported in that position by a pair of supporting fins 48 and 50. Interior chamber 46 is in alignment with the hole 38. The anchor bolt 16 is to be located through interior chamber 46 and through the hole 38 with the lower end of the anchor bolt 16, which includes a hook 18, being positioned within the space 14. The upper end of the anchor bolt 16, which includes threaded section 20, protrudes exteriorly above the upstanding sleeve 44. The amount of this protrusion is preselected with the end 52 of the anchor bolt 16 to be located a given distance such as six inches above the mounting plate 30. This position of the anchor bolt 16 is maintained by a conventional nut 54 being threaded onto threaded end 20 and resting on the outer edge of the upstanding sleeve 44 as is again clearly shown in FIGS. 1 and 2 of the drawing.

It is to be understood that for certain installations, sleeve 44 may be only three to four inches in length. For other installations, sleeve 44 may be five to six inches in length. Therefore, it is within the scope of this invention that there will be various sizes of the apparatus 28 with not only there being a variation in the length of the sleeve 44, but also in a variation in the diameter of the interior chamber 46. However, for most variances in sizes of anchor bolt 16, it has been found that two in number of sizes for the apparatus 28 will suffice. Once the cement is poured and partially cured, the apparatus 28 will be removed leaving the anchor bolt.

What is claimed is:

1. An apparatus for positioning anchor bolts within concrete which is to be poured within a pre-erected form, composed of a pair of parallel spaced apart boards, said form comprising the space between said boards, said apparatus comprising:

a mounting plate, said mounting plate being rigid and not penetratable, said mounting plate to be fixedly mounted on both said boards at a precise preselected position, said mounting plate having an upper surface and a lower surface, said lower surface to be located directly adjacent the concrete;

an upstanding sleeve mounted on said upper surface of said mounting plate, said upper surface having a through opening, said through opening having a longitudinal center axis, said upstanding sleeve being of a preselected length, an anchor bolt is adapted to be located within said through opening with the outer portion of the anchor bolt to extend from said mounting plate and be embedded within the cement after pouring and curing of such; and said mounting plate including a series of holes with there being a series of said holes located directly adjacent each longitudinal end of said mounting plate, a said hole within said series of holes at each end of said mounting plate to have conducted therethrough a fastener with each said fastener then being embedded within a said form.

2. The apparatus as defined in claim 1 wherein:

said mounting plate further including a pair of visual observing openings with there being a single said visual observing opening located directly adjacent each end of said mounting plate, each said visual observing opening facilitating precise positioning of said mounting plate on said boards.

3. The apparatus as defined in claim 2 wherein:

said mounting plate having a longitudinal mid-point, said upstanding sleeve being mounted at said longitudinal mid-point so said longitudinal center axis coincides with said mid-point.

* * * * *